United States Patent [19]

Eichinger

[11] 4,148,262

[45] Apr. 10, 1979

[54] RAILWAY VEHICLE DRIVE

[75] Inventor: Johann Eichinger, Putzbrunn, Fed. Rep. of Germany

[73] Assignee: Carl Hurth Maschinen-und Zahnradfabrik, Munich, Fed. Rep. of Germany

[21] Appl. No.: 746,946

[22] Filed: Dec. 2, 1976

Related U.S. Application Data

[63] Continuation of Ser. No. 584,847, Jun. 9, 1975, abandoned, which is a continuation of Ser. No. 401,860, Sep. 28, 1973, abandoned.

[30] Foreign Application Priority Data

May 22, 1973 [DE] Fed. Rep. of Germany ..... 2325787
Jun. 13, 1973 [DE] Fed. Rep. of Germany ..... 2330000

[51] Int. Cl.[2] ..... B61C 9/44; B61C 9/52; B61F 3/04; F16H 1/14

[52] U.S. Cl. ..... 105/131; 74/390; 74/417; 74/797; 105/109; 105/117; 105/133; 105/135

[58] Field of Search ..... 74/390, 417, 424, 785, 74/789, 797, 799, 802, 803; 105/96, 131, 132, 132.1, 133, 135, 136, 137, 139, 182, 224.1, 109, 117

[56] References Cited

U.S. PATENT DOCUMENTS

| | | | |
|---|---|---|---|
| 463,356 | 11/1891 | Short | 105/139 X |
| 568,779 | 10/1896 | Lockwood | 105/131 X |
| 590,616 | 9/1897 | House | 74/417 X |
| 1,274,781 | 8/1918 | Rathbun | 74/789 X |
| 1,289,531 | 12/1918 | Parsons | 74/390 |
| 1,367,625 | 2/1921 | Pender | 105/131 X |
| 1,463,447 | 7/1923 | Stahl | 74/785 |
| 1,832,300 | 11/1931 | Griswold | 105/132 |
| 2,263,310 | 11/1941 | Piron | 105/224.1 X |
| 2,766,703 | 10/1956 | Cooke | 105/96 X |
| 2,922,383 | 1/1960 | Oestreicher | 105/131 X |
| 3,408,954 | 11/1968 | Kademann et al. | 105/135 X |
| 3,602,153 | 8/1971 | Korn | 105/131 |
| 3,626,862 | 12/1971 | Korn et al. | 105/132.1 X |
| 3,661,096 | 5/1972 | Kayserling | 105/131 X |

FOREIGN PATENT DOCUMENTS

| | | | |
|---|---|---|---|
| 838452 | 5/1952 | Fed. Rep. of Germany | 105/135 |
| 1127934 | 4/1962 | Fed. Rep. of Germany | 105/135 |
| 638962 | 4/1962 | Italy | 105/135 |

*Primary Examiner*—Francis S. Husar
*Assistant Examiner*—Howard Beltran
*Attorney, Agent, or Firm*—Blanchard, Flynn, Thiel, Boutell & Tanis

[57] ABSTRACT

Drive system for a railway vehicle. In a railway vehicle utilzing a high speed motor whose output shaft is arranged generally parallel to the direction of movement of the vehicle, there is provided a gearing system for connecting said motor to a driven axle of the vehicle of such nature that only a minimum of unsprung mass is present and said gearing occupies only a small amount of space. In general, the motor drives through at least two series connected gear reduction units and the output of the second thereof drives a hollow shaft surrounding the vehicle axis and flexibly connected thereto. Thus, the entire drive system excepting only for the flexible connection to the axle may be mounted on the spring supported portion of the vehicle.

11 Claims, 9 Drawing Figures

RAILWAY VEHICLE DRIVE

This is a continuation of application Ser. No. 584,847, filed June 9, 1975, now abandoned which is a continuation of application Ser. No. 401,860, filed Sept. 28, 1973 abandoned.

FIELD OF THE INVENTION

This invention relates to a drive mechanism for the drive axles of railway vehicles having a drive motor, particularly an electric motor, with an output shaft lying substantially in the direction of movement.

BACKGROUND OF THE INVENTION

The basic object of the invention is to provide a rail vehicle having only a small unsprung mass, which is driven by a high-speed motor, particularly an electric motor. A more limited object consists in accommodating a high-ratio reuction gearing in a space-saving manner between the motor and the last gear member of the spring-mounted mass because accommodating the driving means in the space available for this purpose is frequently problematic, especially in high-speed rail vehicles. On the other hand, the reliable torque transmission from the spring-mounted to the unsprung part of the vehicle is of great importance, especially in high-speed rail vehicles.

The basic object of the invention is attained in that the electric motor acts through at least one gear set onto at least one hollow shaft which surrounds the drive axle and is connected to the same by means of an angularly and/or radially movable coupling, for example a universal joint coupling, the said gear set consisting of two reduction gearings which are connected in series and of which at least one is an angular drive, for example a bevel gear train.

Several advantageous embodiments are proposed to achieve the objects of the invention. Thus a tractive unit of the invention can be designed in such a manner that at least one spur gear system with a parallel drive and driven shaft is connected to the electric motor, the driven member of which is coupled with the driving member of the angular drive, for example the bevel gear train.

Advantageous installation conditions are obtained with a drive mechanism in which the spur gear system has coaxially arranged drive and driven members, the conditions being particularly favorable if the spur gear system is a planetary gearing with a fixed planet carrier because this enables a high reduction ratio to be obtained in a minimum of space.

The reduction ratio can be further increased while occupying approximately the same space by using a gearing in which the spur gear is a planetary gearing with a rotating planet carrier.

Various advantageous designs are possible for the angular drive. Thus the angular drive can advantageously be a bevel gear train having its gear axes in the same plane and comprising bevel gears which may be in the form of straight, skew or spiral bevel gears. For the design of the vehicle it may be expedient to use a transmission in which the angular drive is a bevel gear train with offset taxes (FIG. 5).

In the event that space conditions are problematic, it may be useful to employ a drive mechanism in which at least one angular drive, for example a bevel gear train, is connected to the electric motor, the driven member of such angular drive being coupled with the drive member of a spur gear system whose driven gear is arranged on or adjacent to the hollow shaft in a manner providing torque transmission thereto.

A further object of the invention consists in a development of the drive mechanism described above, to the effect that the spur gear system combines a high reduction ratio with a small center distance. This object is achieved by a drive mechanism in which a spur gear system having a substantially parallel drive and driven shaft is connected with the electric motor, such spur gear system substantially consisting of a drive pinion and an internally toothed spur gear which meshes with the said drive pinion, such internally toothed spur gear, which acts as a driven member, being coupled to the drive member of the angular drive, for example the bevel gear train, and the driven member of such angular drive, in turn, being coupled to the hollow shaft.

To permit a certain flexibility between the housing of the drive motor and the housing of the gearing without any detrimental effects on bearings and gears, a further embodiment of the invention provides for an angularly movable coupling, for example a toothed coupling, which is arranged between the drive motor and the drive pinion of the spur gear sytem.

To ensure a favorable position of the electric drive motor relative to the drive axle and to provide for low-noise operation, an expedient emobdiment consists in a drive mechanism in which the angular drive is a bevel gear train with offset axes.

Further advantages and characteristics of the invention are disclosed in the following description.

BRIEF DESCRIPTION OF THE DRAWINGS

The invention is explained in connection with the several illustrative embodiments appearing in FIGS. 1 to 8.

DETAILED DESCRIPTION

Figure 1A:
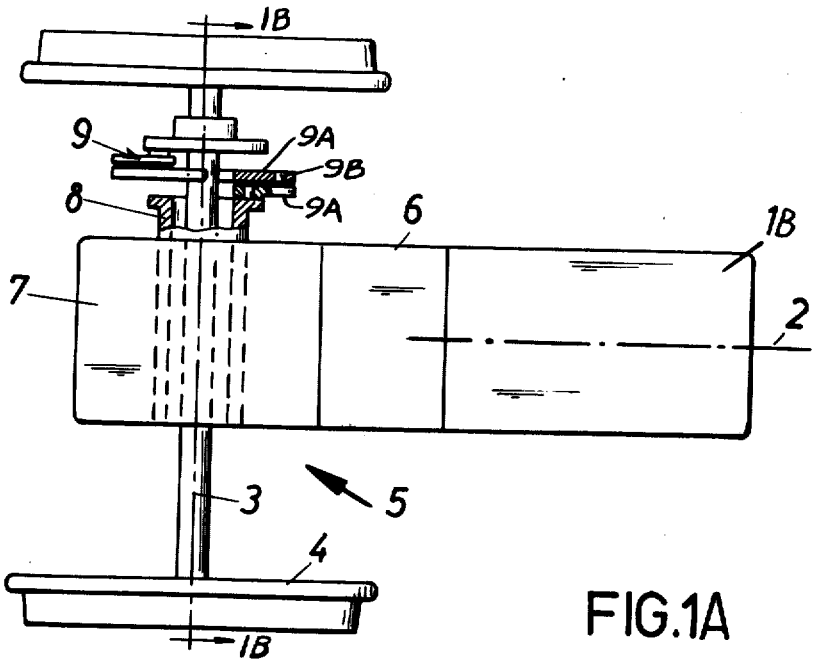
FIG. 1A schematically illustrates the general arrangement comprising the invention.
Figure 1B:
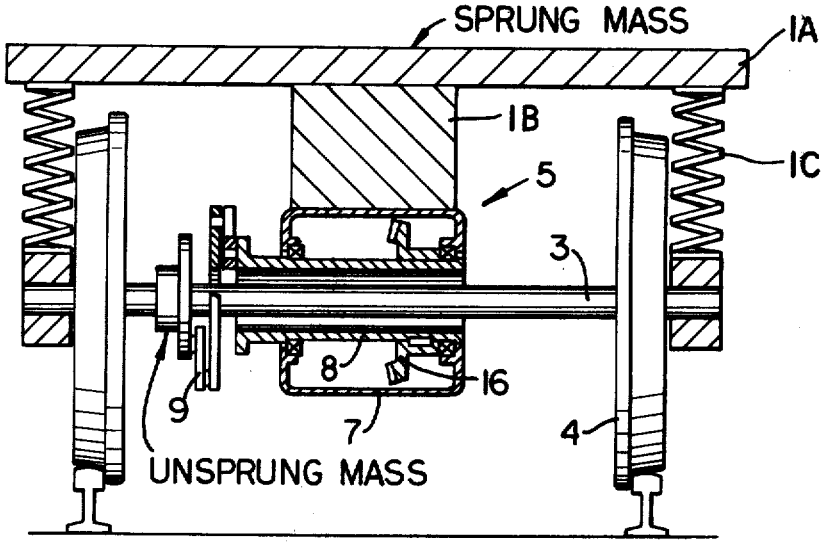
FIG. 1B is a sectional view taken along the line 1B—1B of FIG. 1A to illustrate the conventional spring support between the sprung and unsprung masses.

FIG. 1 schematically illustrates one example of the general arrangement of a drive unit. In the frame of a rail-guided tractive unit, or in its truck, an electromotor 1B is installed in such a manner that the axis 2 of its shaft lies substantially in the direction of movement or substantially perpendicularly to the drive axle 3 which carries the wheels 4. Springs 1C are conventionally provided between the frame 1A of the sprung mass and the drive axle 3 of the unsprung mass. A gear set 5 is connected to one end of the electromotor assembly, or is secured in any other suitable manner, and said gear set consists of two series connected reduction gears units 6 and 7. The second reduction gear unit 7 receives the hollow shaft 8 which surrounds the drive axle 3. Both are connected to an angularly and/or radially movable coupling, for example to a universal joint coupling 9 consisting of a levers 9A and pivot connections 9B or a so-called dancing ring. Even though for this purpose any suitable joint coupling can be provided, a universal joint coupling is assumed in the following examples.

In FIG. 1 only one drive axle is driven through a gear set. However, it is also possible to arrange at the other end of the motor unit another drive mechanism, as described above and as schematically illustrated in FIG. 4.

Figure 2:
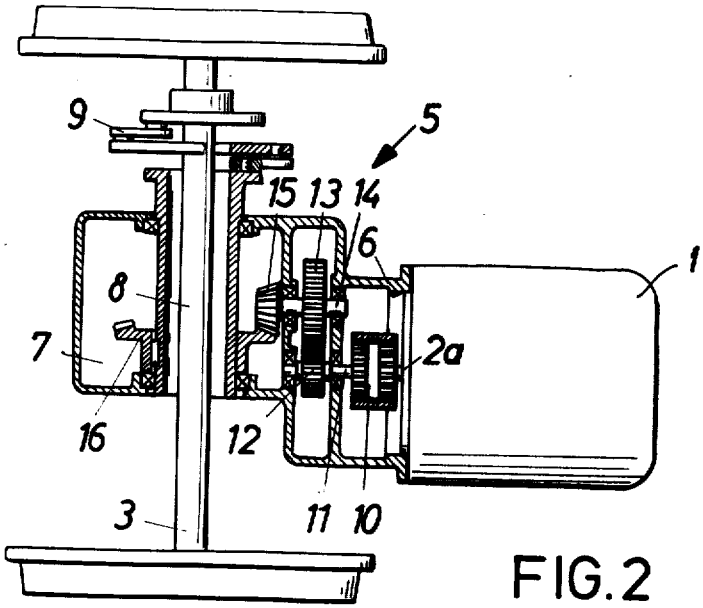
FIG. 2 schematically illustrates a cross-sectional view of one drive mechanism according to the invention.

FIG. 2 illustrates the details of a first exemplary embodiment. The gear set 5 here consists of a spur gear system and a bevel-gear train. In detail the design is as follows. The spur gear system includes a spur gear pinion 12 which mates with a spur gear 13 and is driven from the shaft 2a of the electromotor through a coupling 10, for example a toothed coupling which can also have an elastic member, and through a drive shaft 11. Both gears represent the unit 6 of the reduction gear. At the end of the shaft 14 of the spur gear there is provided a bevel-gear pinion 15 which mates with a bevel gear 16 mounted on the hollow shaft 8. This bevel-gear train comprises the second reduction unit 7 of the gear set. The hollow shaft then drives as already described through the universal joint coupling 9 to the drive axle 3. Slide bearings or ball or roller bearings can be used for supporting the gear system and bevel roller bearings are advantageous for supporting the hollow shaft. In this discussion the arrangement of the gearing with respect to the reduction gear is important. Details of the couplings, the lubrication, sealing, the housings etc. are therefore, because known in principle, not illustrated and described.

Figure 3:
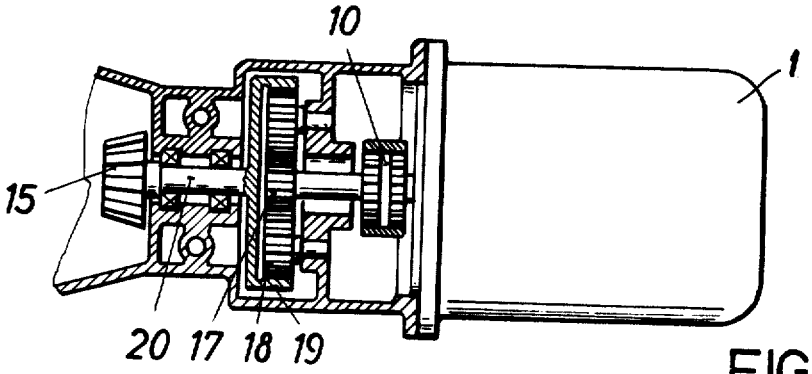
FIG. 3 illustrates a different exemplary embodiment according to the invention.

FIG. 3 illustrates an embodiment in which the first reduction step is a false or stationary planetary gear system. This has the advantage that a high reduction ratio can be accommodated in a small space and that the drive and the output can be coaxial. The coupling 10 drives a center gear 17 which mates with a number of intermediate gears 18 which are supported by stationary pins or the like on the housing and are equally spaced circumferentially around the central gear. The intermediate gears mate, similarly to the planet gears of a planetary gearing, with an internally toothed ring gear 19 which is supported on one end of a drive shaft 20. The drive shaft carries on the free end the already mentioned bevel-gear pinion 15. The further construction of the drive mechanism corresponds to FIG. 2.

Figure 4:
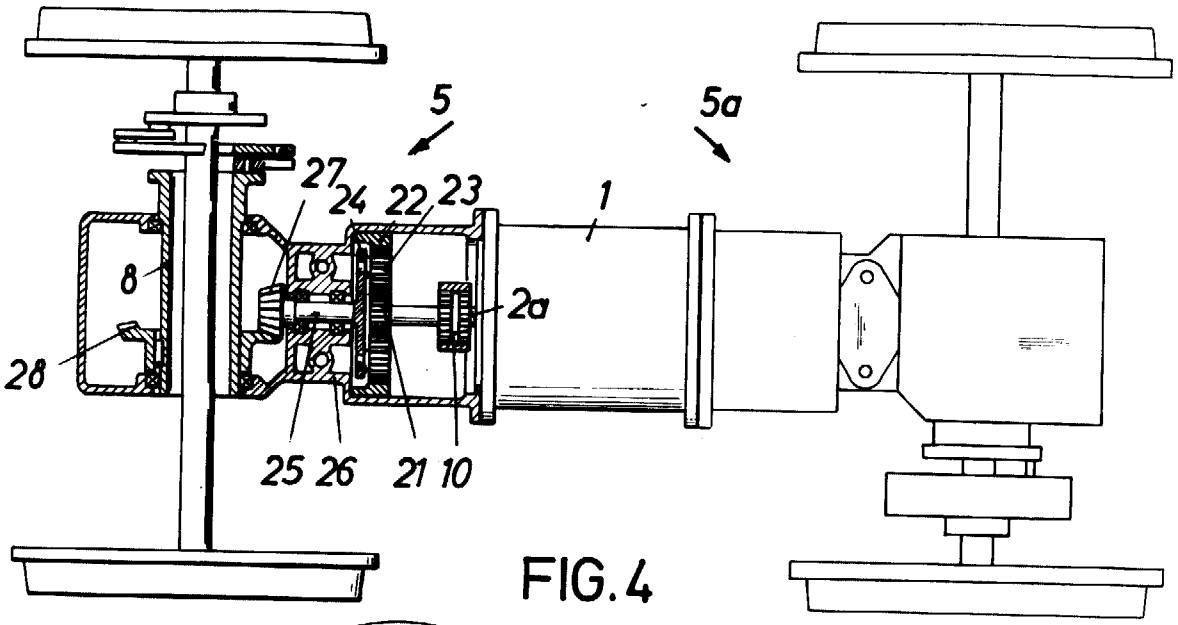
FIG. 4 illustrates an exemplary embodiment having a planetary gear gearing.

FIG. 4 illustrates a further development of the above described embodiment namely in that the reduction gear which is connected to the electromotor is a planetary gear system. In detail this embodiment has the following arrangement. The electromotor 1 drives by means of its shaft 2a through the coupling 10 which can be radially and/or angularly, flexibly and/or elastically connected to the sun pinion 21 of a planetary gearing. This sun pinion can, the same as the corresponding gear of the first reduction gear of the above described embodiments, be mounted directly on the motor shaft. An internally toothed ring gear 22 is arranged on the housing fixed with respect to rotation or is formed integrally therewith. The radial distance between sun pinion and ring gear is occupied preferably by several planetary gears 23 which mate both with the sun pinion and also with the ring gear. The planetary gears are supported in a conventional manner in a planet carrier 24 which in turn is arranged on the end of an intermediate shaft 25. The intermediate shaft is supported by antifriction bearings or other suitable bearings in the housing 26. A bevel-gear pinion 27 is fixed on the free end of the intermediate shaft, which bevel-gear pinion mates with a bevel gear 28 arranged corresponding with the above described embodiments on the hollow shaft 8. This bevel gear train forms the second reduction gear of the gear set.

The spur gear system and the planetary gearing can themselves be constructed as multi-stage reduction gears, in case the rotational speed difference between electromotor and drive axle should be too great for a two-stage gear set. FIG. 4 further illustrates schematically an embodiment with two gear sets 5, 5a of which each set is provided on one end of the electromotor so that two drive axles can be driven.

Figure 5:
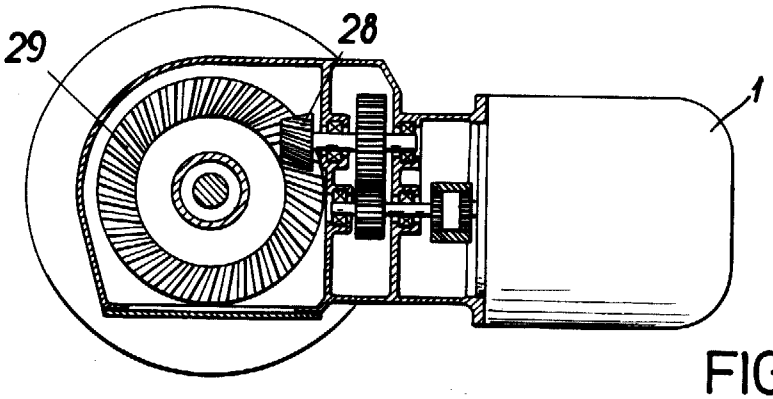
FIG. 5 illustrates an exemplary embodiment having a bevel-gear train, which has offset axes.

FIG. 5 illustrates a modification from the embodiment of FIG. 2 in that a gear system is chosen for the bevel gear reduction gear in which the axis of the bevel-gear pinion 28 and the axis of the bevel gear 29 mounted on the hollow shaft do not lie in the same plane. This gearing can for example be a so-called hypoid gearing.

Figure 6:
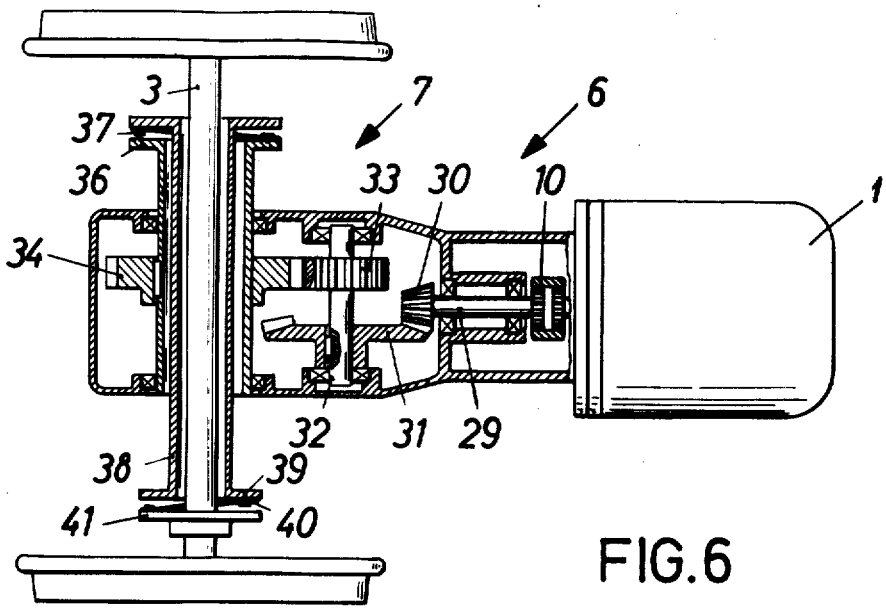
FIG. 6 illustrates an exemplary embodiment in which the last step is a spur gear system.

FIG. 6 illustrates an embodiment in which the first reduction gear 6 is a bevel-gear train and the second reduction gear 7 is a spur gear system. The electromotor drives through the said coupling 10 a pinion shaft 29 on the free end of which a bevel-gear pinion 30 is fixedly arranged. The bevel-gear pinion can also be mounted directly on the shaft of the electromotor. This bevel-gear pinion mates with a bevel gear 31 on the shaft 32 of which a spur gear pinion 33 is fixedly mounted. The spur gear pinion engages a spur gear 34 which is fixedly arranged on the hollow shaft 35. For the angularly and/or radially movable coupling between hollow shaft and drive axle 3, as an example a type is chosen which is arranged at both ends of the hollow shaft.

As a modification of FIG. 6, a number of links 37 are hinged in tangential direction to the hollow shaft by means of a star 36 or the like connected therewith, and said links are at their other ends pivotally connected to a star which is carried by an inner hollow shaft 38. At the other end which projects from the gear housing, the inner hollow shaft is also provided with a star 39 to which also a number of links 40 are pivoted in tangential direction (again departing from FIG. 6 wherein the links lie in or parallel to the plane of the drawing), which links are at their other ends pivotally connected to a star 41 which is fixedly mounted on the drive axle. The spur gear system which is illustrated in this example can also be instead of one stage unit a multistage unit.

In the examples a bevel-gear train was used as the angular drive. It is also possible to use any other known and suitable gearing, thus, for example also a gearing comprising worm gears or a toothed-wheel gearing with crossed axes. In the bevel gear system it is possible to use any suitable and known type, thus for example a hypoid, spiroid, planeoid or a helicon gearing. It is possible to use for the bearings depending on suitability slide, ball or bevel, roller bearings or modifications thereof.

Figure 7:
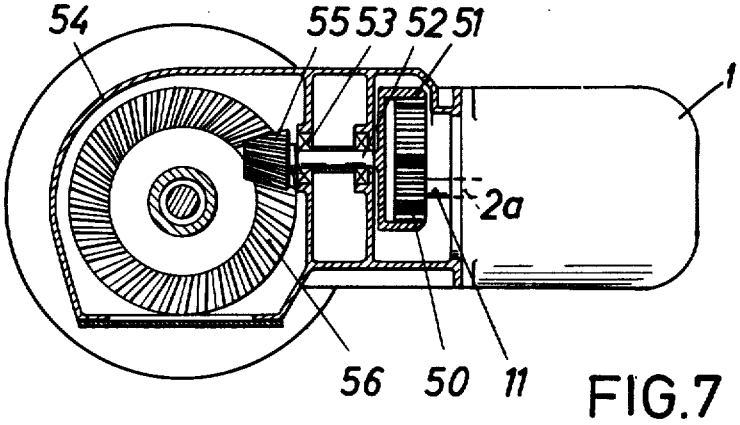
FIGS. 7 and 8 illustrate further exemplary embodiments of the invention.

FIG. 7 illustrates details of a further exemplary embodiment. The gear set 5 consists of a spur gear system and a bevel-gear train. In detail the design is the following. From the shaft 2a of the electromotor through a drive shaft 11 a drive pinion 50 of a spur gear system is driven. The drive shaft can also be integral with the shaft of the electromotor. The drive pinion mates with an internally toothed spur gear 51 which is supported by a shaft 52 and with bearings 53 in the gear housing 54. On the free end the shaft 52 carries a bevel-gear pinion 55 which serves as drive member for an angular drive. The bevel-gear pinion mates with a bevel ring gear 56 which is secured in a suitable manner on the hollow shaft 8. In the described bevel-gear train the shafts 52 and 8 do not lie in a single plane, but instead are offset, as for example in a so-called palloid or hypoid gearing.

Figure 8:
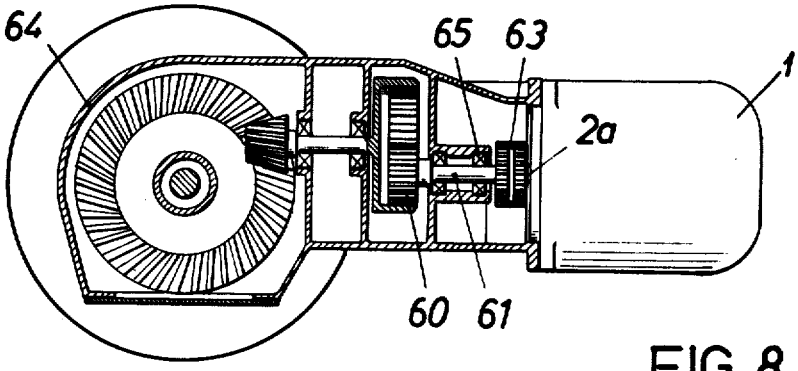

A different exemplary embodiment is illustrated in FIG. 8 which departs substantially from the example of FIG. 7 in that between the shaft 2*a* of the electromotor and the shaft 61 carrying the drive pinion 60 of the spur gear system a coupling 63 is provided which should be elastic and/or flexible. It is possible to advantageously provide a so-called toothed coupling for this purpose. The shaft 61 is supported with bearings 65 in the housing. The remaining structure corresponds approximately to the gearing according to FIG. 2.

The embodiments of the invention in which an exclusive property or privilege is claimed are defined as follows:

1. A drive mechanism for at least one axle of a sprung railway vehicle having at least a pair of axles, comprising:

frame means being sprung on said axles;

high speed drive motor means mounted on said frame means and being arranged between said pair of axles and having output shaft means extending in a direction parallel to the longitudinal direction of travel of said vehicle;

means defining a hollow shaft encircling said one axle and first support means on said frame means for supporting said hollow shaft for rotation, said hollow shaft having an axis parallel to the axis of said one axle and a sufficiently large inner diameter to permit a relative radial movement between said one axle and said hollow shaft;

means defining at least one torque transmitting member connected to and extending between said one axle and said hollow shaft, said torque transmitting member including lever means and pivot means for pivotally connecting said lever means to said axle and said hollow shaft for permitting said relative radial movement between said one axle and said hollow shaft while simultaneously maintaining said parallel axes in alignment and transmitting torque therebetween;

gear drive means supported on said sprung frame and connecting said output shaft means to said hollow shaft, said gear drive means consisting of at least two stages of reduction of speed, one of said stages of reduction of speed being a bevel gear train having a driving member and a driven member, said driving member consisting of a bevel pinion gear and said driven member consisting of a bevel gear drivenly connected to said bevel pinion gear, said driven bevel gear being fixedly mounted to said hollow shaft, the axes of said bevel gear train being offset from each other and the other of said stages of reduction of speed being a spur gear train having a driving member and a driven member, said driving member consisting of a spur pinion gear connected to said output shaft means of said drive motor means, said driven member consisting of a spur gear drivenly connected to said spur pinion gear and second support means on said frame means for supporting said spur gear for rotation on said frame means and connecting means for connecting said spur gear to said bevel pinion gear.

2. A drive mechanism according to claim 1, wherein said spur gear train has coaxially arranged drive and driven shafts.

3. A drive mechanism according to claim 2, wherein said spur gear train is a stationary planetary gearing.

4. A drive mechanism according to claiim 2, wherein said spur gear train is a planetary gearing.

5. A drive mechanism according to claim 1, wherein said output shaft means includes a flexible coupling between the output shaft of said drive motor means and said bevel pinion gear.

6. A drive mechanism according to claim 1, wherein said output shaft means includes a flexible coupling between the output shaft of said drive motor means and said spur pinion gear.

7. A drive mechanism according to claim 6, wherein said output shaft means includes a second spur gear secured to said output shaft; and wherein said means defining a flexible coupling consists of a shaft rotatably supported on said frame means and having said spur pinion gear mounted on one end thereof for rotation therewith and a third spur gear mounted on the other end also for rotation therewith and a flexible internally toothed sleeve encircling said second and third spur gears.

8. A drive mechanism for at least one axle of sprung railway vehicle having at least a pair of axles, comprising:

frame means being sprung on said axles;

high speed drive motor means mounted on said frame means and being arranged between said pair of axles and having output shaft means extending in a direction parallel to the longitudinal direction of travel of said vehicle;

means defining a hollow shaft encircling said one axle and first support means on said frame means for supporting said hollow shaft for rotation, said hollow shaft having an axis parallel to the axis of said one axle and a sufficiently large inner diameter to permit a relative radial movement between said one axle and said hollow shaft;

means defining at least one torque transmitting member connected to and extending between said one axle and said hollow shaft, said torque transmitting member including lever means and pivot means for pivotally connecting said lever means to said axle and said hollow shaft for permitting said relative radial movement between said one axle and said hollow shaft while simultaneously maintaining said parallel axes in alignment and transmitting torque therebetween;

gear drive means supported on said sprung frame and connecting said output shaft means to said hollow shaft, said gear drive means consisting of at least two stages of reduction of speed, one of said stages of reduction of speed being through a bevel gear arrangement having offset axes, one bevel gear being fixedly mounted on said hollow shaft, the other bevel gear being a pinion gear and being connected to a driven shaft of an internally toothed spur gear, said output shaft means having a spur gear connected thereto and engageable with the teeth of said internally toothed spur gear.

9. A drive mechanism according to claim 8, wherein said output shaft means includes means defining a flexible coupling between the output shaft of said drive motor means and said spur gear, the teeth of said spur gear engaging said teeth of said internally toothed spur gear.

10. A drive mechanism according to claim 9, wherein said output shaft means includes a second spur gear secured to said output shaft; and wherein said means defining a flexible coupling comprises a shaft rotatably supported on said frame means and having said spur gear mounted on one end thereof for rotation therewith and a third spur gear mounted on the other end also for rotation therewith and a flexible internally toothed sleeve encircling said second and third spur gears.

11. A drive mechanism according to claim 10, wherein said flexible coupling is a spline coupling.

* * * * *